US007198099B2

(12) United States Patent
Lugtmeier et al.

(10) Patent No.: US 7,198,099 B2
(45) Date of Patent: Apr. 3, 2007

(54) METHOD AND SYSTEM FOR INJECTING A TREATMENT FLUID INTO A WELL

(75) Inventors: Lubbertus Lugtmeier, Assen (NL); Gerbrand Jozef Maria Van Eijden, Rijswijk (NL)

(73) Assignee: Shell Oil Company, Houston, TX (US)

( * ) Notice: Subject to any disclaimer, the term of this patent is extended or adjusted under 35 U.S.C. 154(b) by 60 days.

(21) Appl. No.: 10/982,236

(22) Filed: Nov. 5, 2004

(65) Prior Publication Data

US 2006/0021750 A1 Feb. 2, 2006

(30) Foreign Application Priority Data

Dec. 1, 2003 (EP) ..... 03257555

(51) Int. Cl.
*E21B 27/00* (2006.01)

(52) U.S. Cl. ..... 166/115; 166/305.1

(58) Field of Classification Search ..... 166/115, 166/116, 305.1
See application file for complete search history.

(56) References Cited

U.S. PATENT DOCUMENTS 4,042,033 A 8/1977 Holland et al. ..... 166/310
5,083,615 A * 1/1992 McLaughlin et al. ..... 166/299
5,875,852 A 3/1999 Floyd et al. ..... 166/387
2005/0098210 A1* 5/2005 Strattan et al. ..... 137/70

* cited by examiner

*Primary Examiner*—Jennifer H. Gay
*Assistant Examiner*—Nicole A Coy

(57) ABSTRACT

A system for injecting a treatment fluid into a well, the system includes: a surface controlled subsurface safety valve; a valve control conduit which extends from the surface controlled subsurface safety valve to a wellhead of the well, wherein the surface controlled subsurface safety valve is controlled by varying the fluid pressure in the valve control conduit; a fluid injection opening in the valve control conduit effective for discharging treatment fluid into the well; a treatment fluid injection conduit arranged which is connected to the valve control conduit; at least one treatment fluid injection opening; and a one way check valve which prevents fluid flow from each treatment fluid injection opening via the treatment fluid injection conduit into the valve control conduit, wherein the treatment fluid injection conduit is arranged into a section of the well which is located below the surface controlled subsurface safety valve such that at least one treatment fluid injection opening is located below the surface controlled subsurface safety valve.

14 Claims, 1 Drawing Sheet

METHOD AND SYSTEM FOR INJECTING A TREATMENT FLUID INTO A WELL

FIELD OF THE INVENTION

The invention relates to a method and system for injecting a treatment fluid into a well.

RELATED APPLICATIONS

This application claims priority to EPC patent application no. 03104119.7 filed on Nov. 7, 2003.

BACKGROUND OF THE INVENTION

It is often desirable to inject a treatment fluid into a crude oil and/or natural gas production well. The treatment fluid may contain a corrosion or hydrate inhibitor, a viscosity reducing agent, a chemical agent to prevent deposition of sulphur, asphaltenes or waxes, or a foam generating agent which inhibits accumulation of condensed water and/or condensates downhole in the well.

Many oil and/or natural gas production wells are equipped with a Surface Controlled Subsurface Safety Valve (known as a SCSSV) which may be suspended at about 100 m depth in the production tubing. A SCSSV automatically closes if the hydraulic pressure in the SCSSV hydraulic control conduit falls away, for example as a result of a power supply interruption at the oil and/or gas production facilities at the earth surface, impact on the wellhead from outside or an emergency shut-down action.

U.S. Pat. No. 4,042,033 suggests a method to inject a chemical fluid into the production tubing above a SCSSV via the hydraulic control conduit of the SCSSV, which is equipped with a chemical injection opening just above the SCSSV. The injected chemical is used to provide hydraulic pressure to keep the SCSSV open, and is bled off into the production tubing above the SCSSV via a one-way check valve that is mounted in the upper part of SCSSV assembly.

A problem associated with the known SCSSV assembly is that it does not allow to inject chemicals into sections of the well below the SCSSV. The SCSSV assembly blocks the possibility of suspending a chemical injection conduit from the wellhead into the production tubing below the SCSSV, as the chemical injection conduit would form an obstruction to closure of the SCSSV in an emergency situation.

SUMMARY OF THE INVENTION

In accordance with some embodiments of the invention there is provided a system for injecting a treatment fluid into a well, the system comprising: a surface controlled subsurface safety valve; a valve control conduit which extends from the surface controlled subsurface safety valve to a wellhead of the well, wherein the surface controlled subsurface safety valve is controlled by varying the fluid pressure in the valve control conduit; a fluid injection opening in the valve control conduit effective for discharging treatment fluid into the well; a treatment fluid injection conduit arranged which is connected to the valve control conduit; at least one treatment fluid injection opening; and a one way check valve which prevents fluid flow from each treatment fluid injection opening via the treatment fluid injection conduit into the valve control conduit, wherein the treatment fluid injection conduit is arranged into a section of the well which is located below the surface controlled subsurface safety valve such that at least one treatment fluid injection opening is located below the surface controlled subsurface safety valve.

The invention also provides, in some embodiments, a system for injecting a treatment fluid into a well comprising a surface controlled subsurface safety valve, which is controlled by varying fluid pressure in a valve control conduit which extends from the safety valve to a wellhead of the well, the system comprising a valve control conduit which comprises at least one treatment fluid injection opening for discharging treatment fluid into the well; and which system further comprises a treatment fluid injection conduit for injecting treatment fluid into the well, which treatment fluid injection conduit is connected to the valve control conduit, and which treatment fluid injection conduit comprises the at least one treatment fluid injection opening and a one way check valve which prevents fluid flow from each treatment fluid injection opening via the treatment fluid injection conduit into the valve control conduit, and wherein the treatment fluid injection conduit is arranged to extend into a section of the well which is located below the safety valve such that at least one treatment fluid injection opening is located below the safety valve.

At least one treatment fluid injection opening is suitably located at a substantial distance below the safety valve.

In a preferred embodiment of the method and system according to the invention the safety valve (SCSSV) is mounted in a production tubing, in particular in a production tubing of a gas well. Suitably then, the treatment fluid injection conduit is suspended from the safety valve into the production tubing below the safety valve such that at least one treatment fluid injection opening is located at a substantial distance below the safety valve. The distance can for example be 100 m or more. The treatment fluid can in particular comprise a foaming agent.

In such case the treatment fluid injection conduit may extend along a length of several kilometers through the production tubing, optionally into an inflow region near the bottom of the wellbore, below the safety valve. The foaming agent may comprise a surface active agent which is injected in a liquid phase through the valve control and treatment fluid injection conduit and which generates a foam if it is blended in the well with aqueous components of the produced natural gas.

The treatment fluid can also comprise a chemical, preferably a metal alkyl, that is reactive with a liquid present in the well to form a reaction product comprising a solid.

Preferably, the valve control conduit comprises:

an elongate upper valve control conduit section which extends through an annular space between the production tubing and a well casing between the wellhead and an opening in the production tubing, and a short lower valve control conduit section which extends through the housing of the safety valve and which is connected to a hydraulic safety valve control mechanism which is configured to maintain the safety valve in an open position if the pressure of the treatment fluid in the lower valve control conduit section is above a predetermined threshold pressure and to close the safety valve if said fluid pressure is below said predetermined threshold pressure.

In such case the safety valve may be retrievably mounted within the production tubing and the treatment fluid injection conduit has an upper section which passes through the housing of the safety valve, which is connected to the lower safety valve control conduit section and which comprises the one way check valve and an elongate flexible lower section which is suspended from a lower end of the safety valve housing into the production tubing below the safety valve.

Preferably, the one way check valve is configured to open if the pressure difference across the one way check valve is above a trigger pressure which is significantly higher than the threshold pressure, such that:

if a moderate fluid pressure is maintained in the valve control conduit such that the threshold pressure is exceeded, but the trigger pressure is not exceeded, the safety valve is open, but the check valve is closed, so that gas is produced via the well, but no treatment fluid is injected into the well via the treatment fluid injection conduit; and if a high fluid pressure is maintained in the valve control conduit, the trigger and threshold pressure are both exceeded such that the safety valve and check valves are both open, and gas is produced to surface and treatment fluid is injected into the produced gas stream via the treatment fluid injection conduit.

The safety valve (SCSSV) may be a flapper type valve, or alternatively a ball valve, and may be equipped with a spring mechanism, which is configured to close the valve if the pressure of the treatment fluid in the lower section of the safety valve control conduit is lower than the threshold pressure.

In some embodiments of the present invention, a method and system is provided for injecting a treatment fluid into a well, which is equipped with a SCSSV, such that only a minimal amount of hydraulic control and chemical injection conduits are present in the well, and such that they only provide minimal obstruction in the wellbore. In other embodiments, a method and system is provided for injecting a treatment fluid into a well which is equipped with a SCSSV to downhole regions of the well that are located below the SCSSV.

These and other features, advantages and embodiments of the method and system according to the invention are described in the accompanying claims, abstract and detailed description with reference to the accompanying drawing.

DETAILED DESCRIPTION OF THE INVENTION

Figure 1:
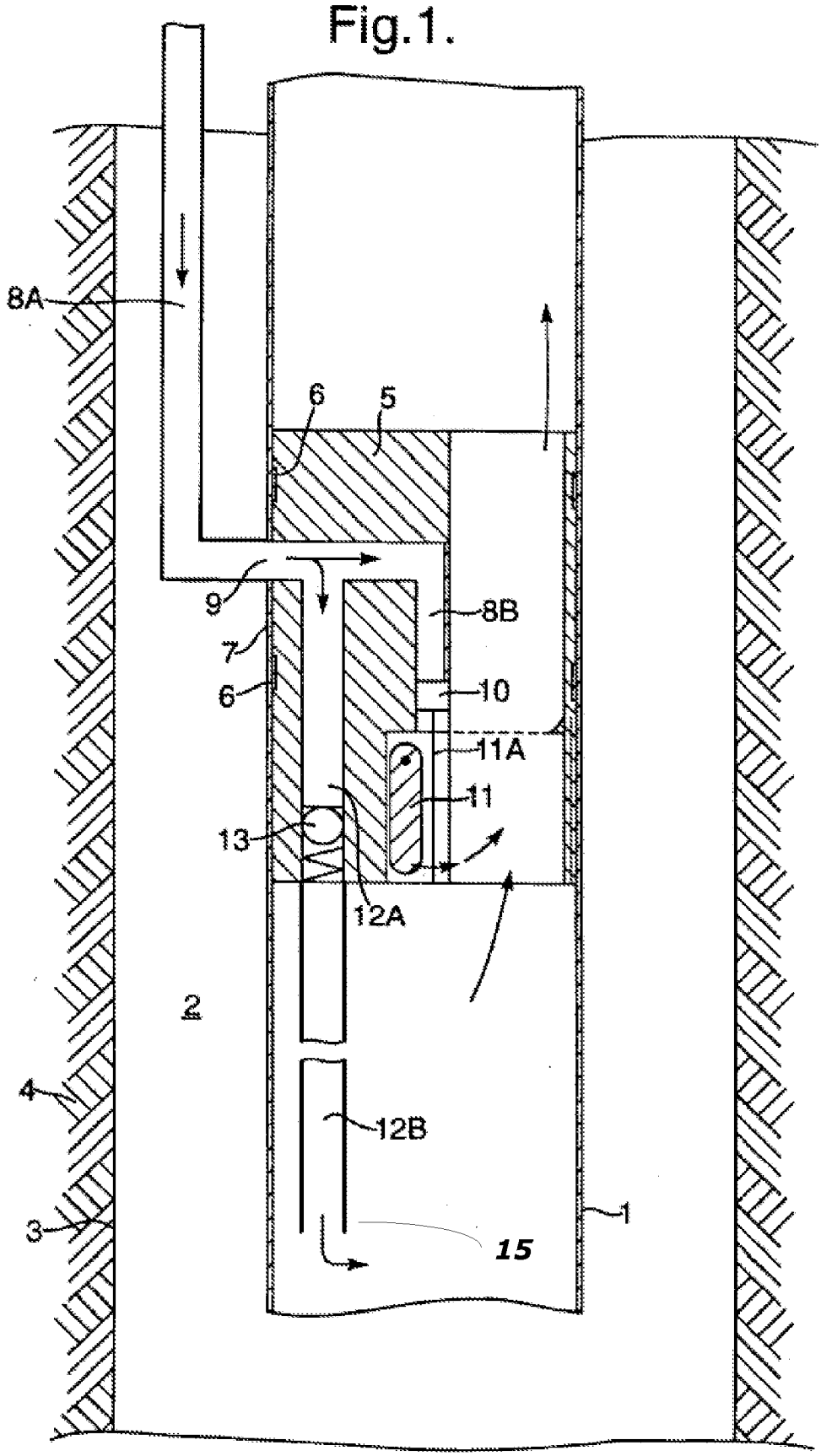
FIG. 1 is a schematic longitudinal sectional view of a production tubing in which a SCSSV is mounted and wherein a treatment fluid is injected into the production tubing below the SCSSV via the SCSSV control conduit and a treatment fluid injection conduit which is suspended from the SCSSV.

FIG. 1 shows schematically an embodiment of the invention. A production tubing 1 is suspended in a natural gas production well 1*a*, such that an annular space 2 is present between the production tubing 1 and a well casing 3. The well casing 3 is cemented or otherwise secured within a subsurface earth formation 4.

A Surface Controlled Subsurface Safety Valve (SCSSV) 5 is secured within the production tubing 1. The SCSSV 5 can be secured to the production tubing so that it is retrievable e.g. by wireline, and rests on a landing shoulder. It can also be mounted in a retrievable tubing, and then there is preferably provided a separate landing shoulder for another surface retrievable SCSSV as a back-up option is case of a failure. An assembly of sealing rings 6 form a sealed annular chamber 7 around the tubular housing of the SCSSV 5. The chamber 7 provides fluid communication between an upper section 8A of a safety valve control conduit 8, which extends through the annular space 2 from a wellhead (not shown) to an opening 9 in the production tubing 1, and a lower section 8B of the safety valve control conduit 8. The lower section 8B extends through the housing of the SCSSV 5 towards a hydraulic piston and cylinder assembly 10 which actuates a bushing 11A to release the flapper valve body 11 of the SCSSCV 5.

The flapper valve body is equipped with a spring (not shown), which pushes the flapper valve body up into a transversal position (indicated by a dashed line) in the production tubing 1 such that the SCSSV is closed if the pressure in said lower section 8B is below a predetermined threshold pressure, and such that if said pressure exceeds the predetermined threshold pressure the valve body 11 is pressed by the piston 10 and bushing 11A into a position as illustrated in FIG. 1, parallel to the longitudinal axis of the production tubing 1, such that the SCSSV 5 is open and permits a stream of natural gas to flow through the production tubing 1 to surface.

The lower section 8B of the SCSSV control conduit is connected to a treatment fluid injection conduit 12. The upper section 12A of the treatment fluid injection conduit 12 extends through the housing of the SCSSV 5 and in this upper section a one way check valve 13 is arranged which prevents fluids to flow up from the treatment fluid injection conduit into the lower section 8B of the SCSSV control conduit.

The treatment fluid injection conduit furthermore comprises a fluid discharge opening 15. In this embodiment the fluid discharge opening forms the lower end of an elongate flexible lower section 12B of the treatment fluid injection conduit, which is suspended from the bottom of the housing of the SCSSV 5 into the section of the production tubing 1 below the SCSSV 5.

The one way check valve 13 is provided with a spring, which is configured such that the spring closes the check valve 13 if the pressure difference across the check valve is below a certain switch value, which is generally reached if the pressure difference across the one way check valve 13 has reached a predetermined trigger value.

Said trigger value is selected well above the threshold value at which the SCSSV 5 closes, such that if a low fluid pressure is maintained in the lower section 8B (and therefore also in the uppermost section of the fluid injection conduit 12A) of the SCSSV control conduit both the SCSSV 5 and one way check valve 13 are closed, whereas if a moderate fluid pressure is maintained in said lower section 8B the threshold is exceeded, but the trigger pressure is not exceeded such that the SCSSV 5 is open, but the one way check valve 13 is closed, and when a high fluid pressure is maintained in said lower section 8B both the threshold and trigger pressure differences are exceeded and both the SCSSV 5 and the one way check valve 13 are open. In this case treatment fluid, which is pumped at the wellhead into the SCSSV control conduit is permitted to flow via said SCSSV control conduit and the treatment fluid injection conduit and one or more treatment fluid discharge openings 15 into the production tubing 1 below the SCSSV 5.

Treatment fluid discharge openings 15 may be arranged at selected intervals along the length of the lower section 12B of the treatment fluid injection conduit such that treatment fluid is injected at different depth intervals along the length of the production tubing 1 below the SCSSV 5.

The treatment fluid may comprise a foaming agent, such as a soap or similar surface active agent, which generates a foam if it is blended with a condensed water or other condensate, which may accumulate near the bottom of the well, and which foam has a lower density and larger surface area than the condensed water or other condensates, and is commingled with the natural gas stream and produced to surface. Suitable foaming agents for use in gas wells may comprise polyoxylakylene sulfates, alkyl quarternay ammonium salts, betines or axyalkylated alkylphenols that are contained in a solvent package comprising glycols and alcohols.

The treatment fluid may also comprise a viscosity reducing agent and/or a hydrate or corrosion inhibitor and/or a wax, asphaltene, scale and/or other antifouling agent or a combination of these. The treatment fluid may also comprise a blend of various chemical compounds.

The present invention also provides a method for treating a well wherein a treatment fluid is injected into the wellbore that comprises a chemical treatment compound for reducing the height of a liquid column in a well. The treatment fluid can in particular be injected via the valve control conduit and the treatment fluid injection conduit.

Many gas wells suffer from liquid loading particularly near the end of their production life. At this stage the pressure in the surrounding formation has dropped considerably, and flow rates of gas have dropped accordingly. Below a certain critical flow rate, liquids start dropping out of the produced gas mixture, and this process is known as liquid loading. Gas well load-up is frequently the cause of abandonment of the well in pressure depleted reservoirs.

Liquids can be formed by condensation in the wellbore, or come from water influx. If the liquid starts accumulating, it will impose a backpressure on the formation that can affect the production capacity of the well. In a low pressure well the liquids may complete kill the well; in wells with higher flowing pressure, slugging or intermittent production of gas/liquid can occur.

A new solution to this problem is it to inject a treatment chemical into the well that reacts with the liquid to form a solid which sinks to the bottom of the well, and optionally a gas. The solid has a substantially higher density than the liquid, so that the loading in the well is reduced.

A suitable treatment fluid to this end comprises a metal alkyl, e.g. $AlR_3$, $BR_3$, $MgR_2$, $ZnR_2$ or a similar compound, wherein R is an alkyl group, e.g. Methyl, Ethyl, Propyl, etc. Al-alkyls in particular are commodity chemicals, cheap and readily available, pure or in solution.

Metal alkyls react instantaneously with water, to form metal oxides and alkanes. The metal oxide will sink to the bottom of the well. The overall reaction gives a volume reduction of typically 95%, thereby extending the life time of a well that suffers from liquid loading.

A typical reaction is the following:

$$2\ Al(C_2H_5)_3+3H_2O \rightarrow Al_2O_3\downarrow+6C_2H_6\uparrow.$$

The aluminium oxide will precipitate at the well bottom, and the ethane gas will be produced to surface. In order to control the reactivity the metal alkyl can be diluted in a hydrocarbon fluid. Also the choice of the various R groups can influence the reactivity towards water.

Table 1 summarizes the results of the reaction of trimethylaluminium and triethylaluminium with water, and the associated volume reduction.

TABLE 1

| $H_2O$ $m^3$ | $AlR_3$ | $AlR_3$ $m^3$ | Gas | Gas $m^3$ (80° C., 50 bar) | $Al_2O_3$ $m^3$ | volume reduction % |
|---|---|---|---|---|---|---|
| 1 | all R = methyl | 3.6 | Methane | 54 | 0.048 | 95 |
| 1 | all R = ethyl | 5.1 | Ethane | 54 | 0.048 | 95 |

The treatment fluid preferably is injected in a liquid phase through the SCSSV control and treatment fluid injection conduits 8 and 12, but may also be injected in a gaseous phase through said conduits. In such case the injected treatment fluid may be injected as a lift gas into the production tubing 1 below the SCSSV 5, to reduce the density of a produced viscous crude oil stream and enhance crude oil production.

If desired, the lower part 12B of the treatment fluid injection conduit may be retrievable secured to the upper part of 12A of the treatment fluid injection conduit by means of landing nipple (not shown) within the lower part of the SCSSV housing. In such a case the lower part 12B of the treatment fluid injection conduit is lowered through the open SCSSV 5 by a wireline tool or well robot and coupled to the landing nipple.

The lower part 12B of the treatment fluid injection conduit may be a steel conduit, which may be several kilometers long and have an outer diameter, which is less than a centimeter, preferably less than a 0.5 centimeter. Such an elongate small diameter conduit contains only a relatively small amount of treatment fluid. This prevents chemical degradation and possible blockage within the treatment injection conduit 12. In case the lower section 12B of the small diameter treatment fluid injection conduit is damaged only a small amount of treatment fluid is released instantly into the wellbore, which does not result in formation damage or blocking production.

The invention claimed is:

1. A system for injecting a treatment fluid into a well, the system comprising:

a surface controlled subsurface safety valve;

a valve control conduit which extends from the surface controlled subsurface safety valve to a wellhead of the well, wherein the surface controlled subsurface safety valve is controlled by varying the fluid pressure in the valve control conduit;

a fluid injection opening in the valve control conduit effective for discharging treatment fluid into the well;

a treatment fluid injection conduit which is connected to the valve control conduit;

at least one treatment fluid injection opening; and a one way check valve which prevents fluid flow from each treatment fluid injection opening via the treatment fluid injection conduit into the valve control conduit, wherein the treatment fluid injection conduit is arranged into a section of the well which is located below the surface controlled subsurface safety valve such that at least one treatment fluid injection opening is located below the surface controlled subsurface safety valve.

2. The system of claim 1 wherein at least one treatment fluid injection opening is located at a substantial distance below the surface controlled subsurface safety valve.

3. The system of claim 1 wherein the treatment fluid injection conduit is suspended downwardly from the surface controlled subsurface safety valve such that at least one treatment fluid injection opening is located at least 100 m below the safety valve.

4. The system of claim 1 wherein the surface controlled subsurface safety valve is mounted in a production tubing of the well and the treatment fluid injection conduit is suspended into the production tubing.

5. The system of claim 1 wherein the treatment fluid comprises a foaming agent.

6. The system of claim 5 wherein the treatment fluid injection conduit extends through production tubing below the surface controlled subsurface safety valve, and the foaming agent comprises a surface active agent which is injected in a liquid phase through the valve control and treatment fluid injection conduit, and which generates a foam if it is blended in the production tubing with aqueous components of produced natural gas.

7. The system of claim 5 wherein the treatment fluid injection conduit extends through production tubing below the surface controlled subsurface safety valve into an inflow region of the well, and the foaming agent comprises a surface active agent which is injected in a liquid phase through the valve control and treatment fluid injection conduit, and which generates a foam if it is blended in the production tubing with aqueous components of produced natural gas.

8. The system of claim 1, wherein the valve control conduit comprises an elongate upper valve control conduit section which extends through an annular space between the production tubing and a well casing between the wellhead and an opening in the production tubing, and a short lower valve control conduit section which extends through the housing of the safety valve and which is connected to a hydraulic safety valve control mechanism which is configured to maintain the surface controlled subsurface safety valve in an open position if a pressure difference between the treatment fluid in the lower valve control conduit and well fluids in flowing through the surface controlled subsurface safety valve is above a predetermined threshold pressure difference and to close the safety valve if the said pressure difference is below said predetermined threshold pressure difference.

9. The system of claim 8, wherein the surface controlled subsurface safety valve is retrievably mounted within the production tubing and the treatment fluid injection conduit has an upper section which passes through the housing of the surface controlled subsurface safety valve, which is connected to the lower safety valve control conduit section and which comprises the one way check valve and an elongate flexible lower section which is suspended from a lower end of the surface controlled subsurface safety valve housing into the production tubing below the safety valve.

10. The system of claim 1 wherein the one way check valve is configured to open if the pressure difference across the one way check valve is above a trigger pressure which is significantly higher than the threshold pressure, such that:

if a moderate pressure is maintained in the lower section of the surface controlled subsurface safety valve control conduit the pressure across the one way check valve is below the threshold pressure, but the pressure difference between the treatment fluid in said lower section is above the trigger pressure below, such that the surface controlled subsurface safety valve is open, but the check valve is closed, and gas and/or crude oil is produced via the well, but no treatment fluid is injected into the well via the treatment fluid injection conduit; and if a high pressure is maintained in the lower section of the safety valve control conduit the fluid pressure difference across the one way check valve is above the trigger pressure, and the surface controlled subsurface safety valve and check valve are both open, and gas and/or crude oil is produced to surface and treatment fluid is simultaneously injected into the produced gas and/or crude oil via the treatment fluid injection conduit.

11. The system of claim 1 wherein the treatment fluid comprises a chemical that is reactive with a liquid present in the well to form a reaction product comprising a solid.

12. The system of claim 11 wherein the treatment fluid comprises a metal alkyl.

13. The system of claim 1 wherein the safety valve is a flapper type valve.

14. The system of claim 1 wherein the surface controlled subsurface safety valve is mounted in a production tubing of the well and the treatment fluid injection conduit is suspended into the production tubing through the production tubing into an inflow region of the well.

* * * * *